United States Patent [19]

Vanderbush, Jr. et al.

[11] Patent Number: 4,572,033

[45] Date of Patent: Feb. 25, 1986

[54] BOTTLE DECAPPER

[75] Inventors: Herman H. Vanderbush, Jr., Whittier; Hugh W. Yarbrough, Claremont, both of Calif.

[73] Assignee: Miller Brewing Company, Milwaukee, Wis.

[21] Appl. No.: 725,300

[22] Filed: Apr. 19, 1985

[51] Int. Cl.[4] ..... B67B 7/08

[52] U.S. Cl. ..... 81/3.2

[58] Field of Search ..... 81/3.2, 3.07, 3.36, 81/3.39

[56] References Cited

U.S. PATENT DOCUMENTS

| | | | |
|---|---|---|---|
| 1,172,447 | 2/1916 | Forte | 81/3.2 |
| 2,650,748 | 9/1953 | Bennett et al. | 226/129 |
| 3,545,174 | 12/1970 | Randrup | 53/381 |
| 3,807,134 | 4/1974 | Zalkin | 53/381 |
| 3,845,605 | 11/1974 | Hartness | 53/3 |
| 3,987,535 | 10/1976 | Brown | 29/427 |
| 4,070,854 | 1/1978 | Marino | 53/381 |
| 4,265,071 | 5/1981 | Smith et al. | 53/492 |
| 4,363,204 | 12/1982 | Ohude et al. | 53/381 |

*Primary Examiner*—James L. Jones, Jr.

*Attorney, Agent, or Firm*—Quarles & Brady

[57] ABSTRACT

A bottle decapper for removing twist-type bottle caps from bottles is disclosed. A conveyor means moves the bottles relative to a frame while holding the bottles rotationally stationary relative to the frame. A cap engaging means positioned above the conveyor means and fixed to the frame includes a primary segment and a back-up segment. The primary segment has a hard file surface positioned in a plane to engage a sidewall of a passing bottle cap in rolling contact to unscrew the bottle cap from the bottle. The back-up segment has a softer surface than the primary segment surface and is positioned downstream from the primary segment surface with the back-up segment surface in approximately the plane of the primary segment surface. The primary segment surface loosens the bottle caps from passing bottles and the back-up segment surface completes unscrewing any caps which were not completely unscrewed by the primary segment surface.

6 Claims, 7 Drawing Figures

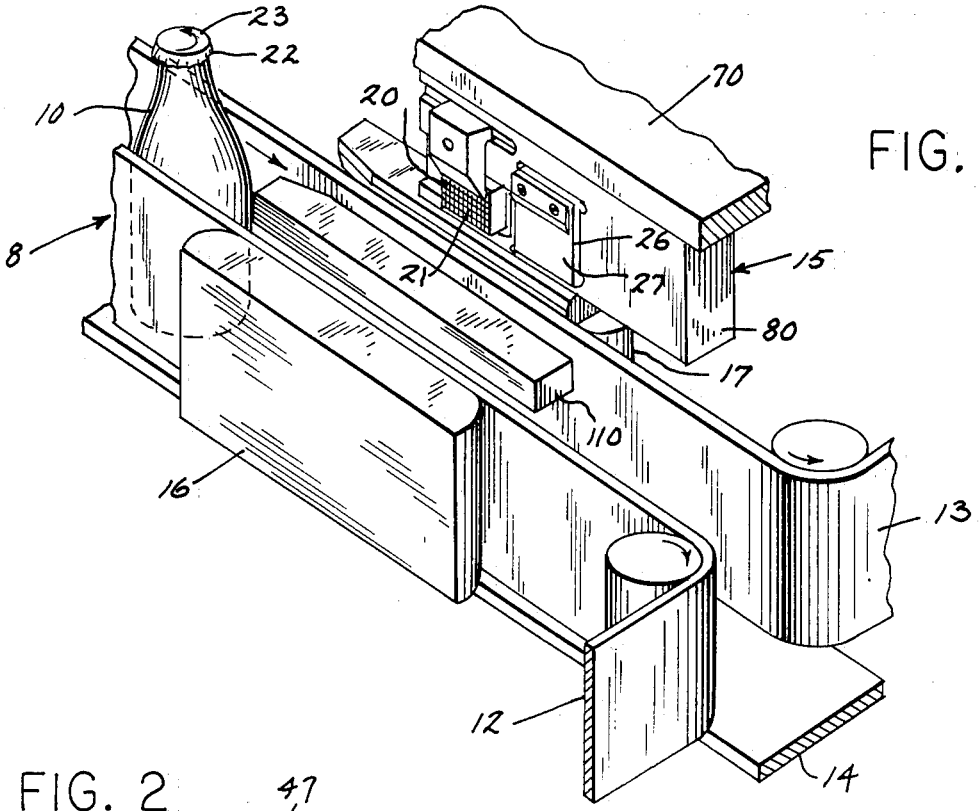
FIG. 1
FIG. 2
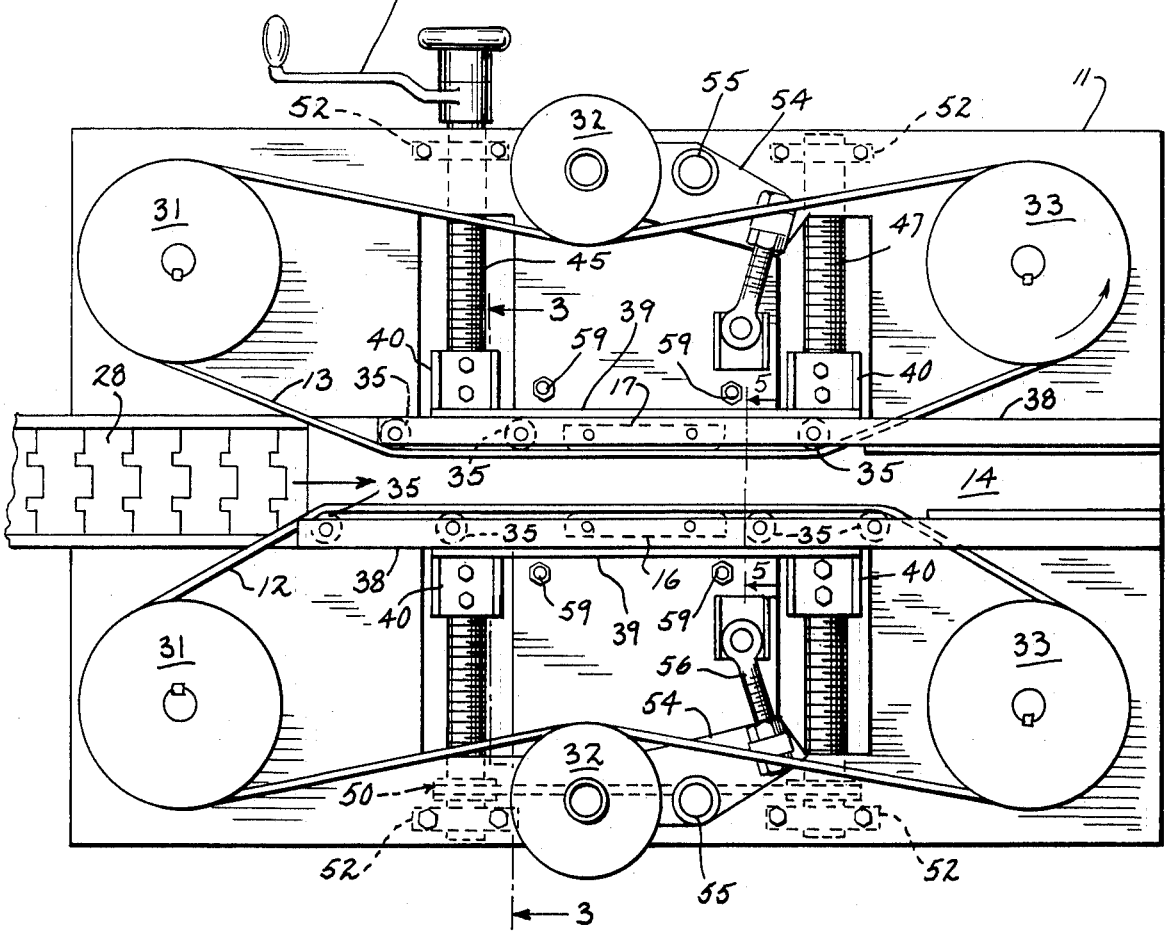

FIG. 3
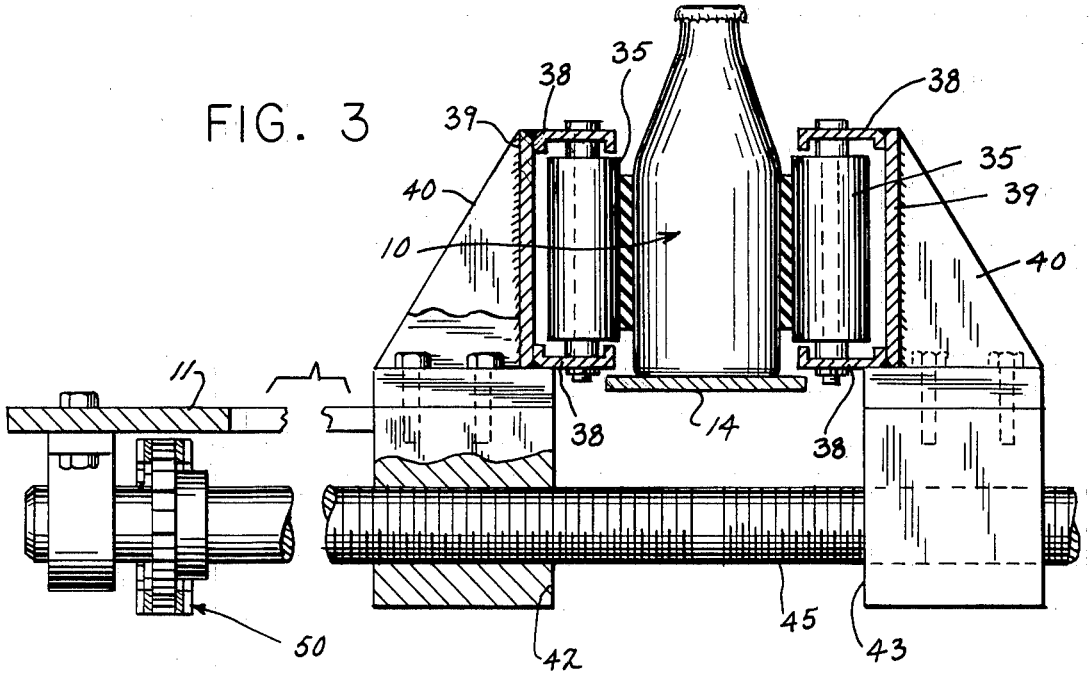
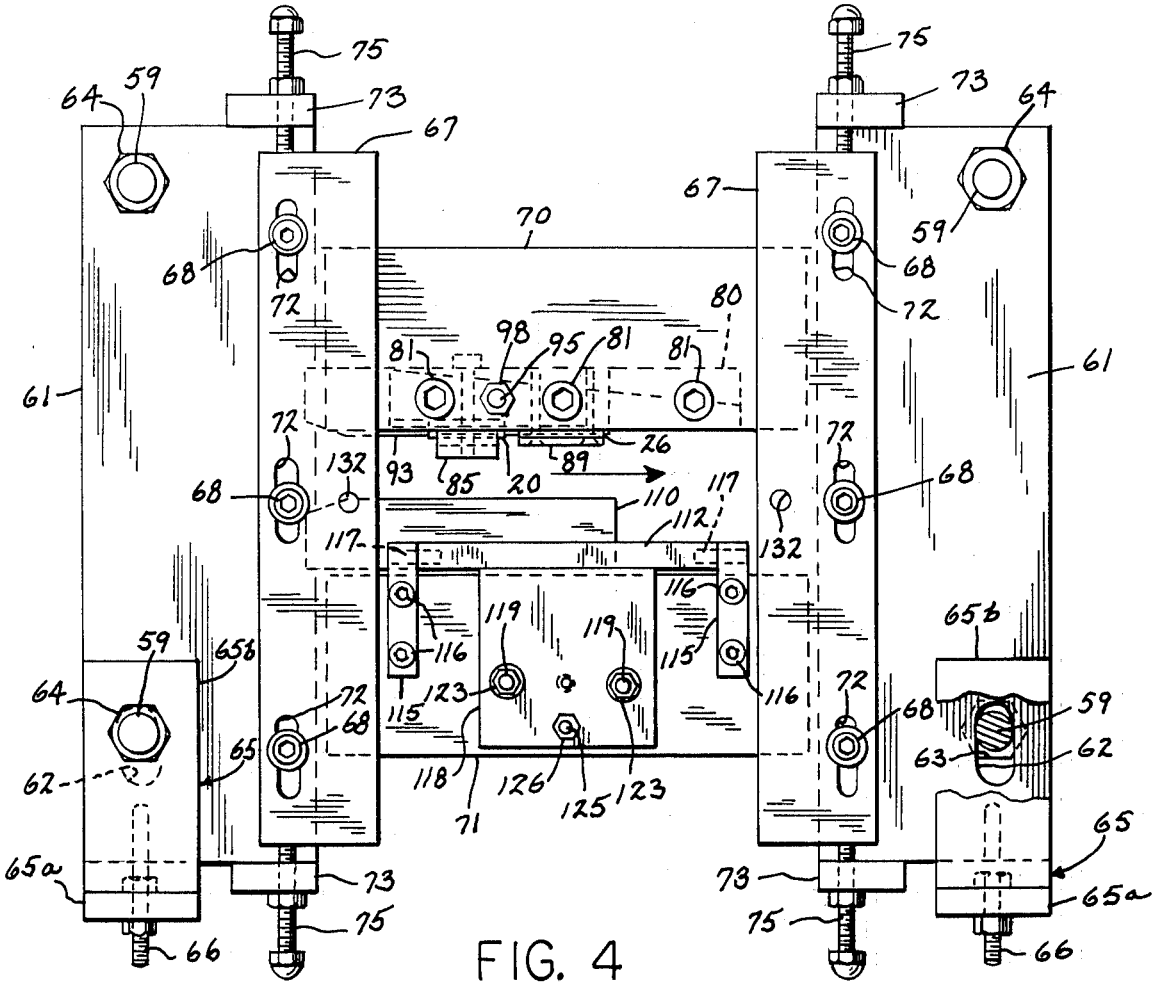
FIG. 4

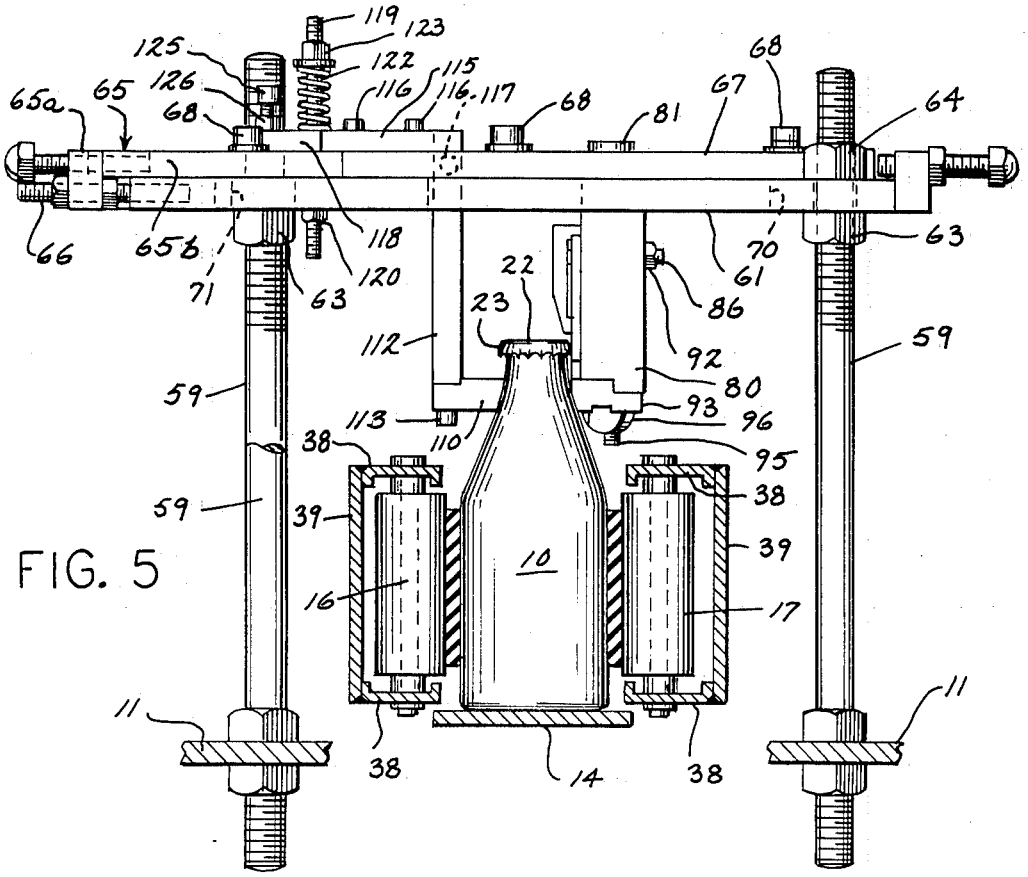
FIG. 5
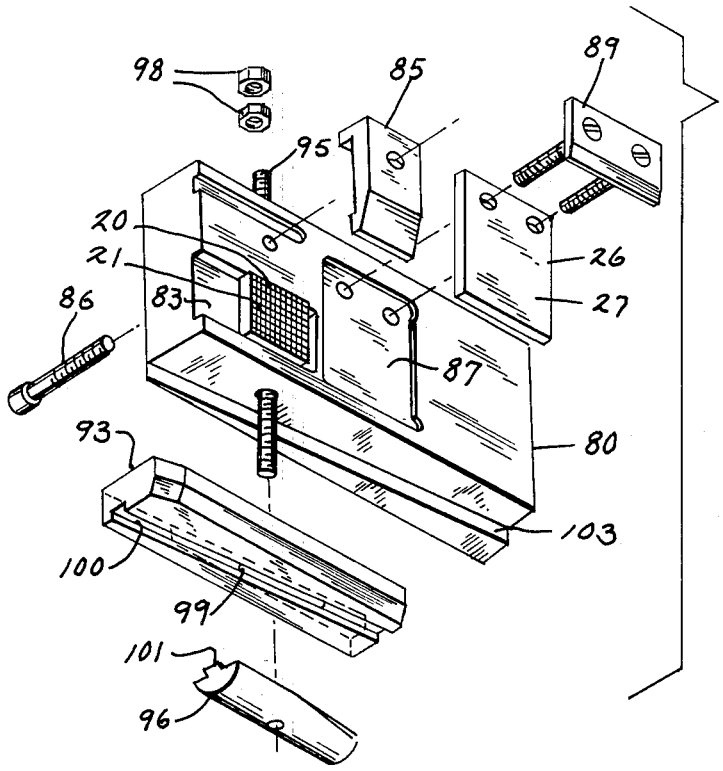
FIG. 6
FIG. 7
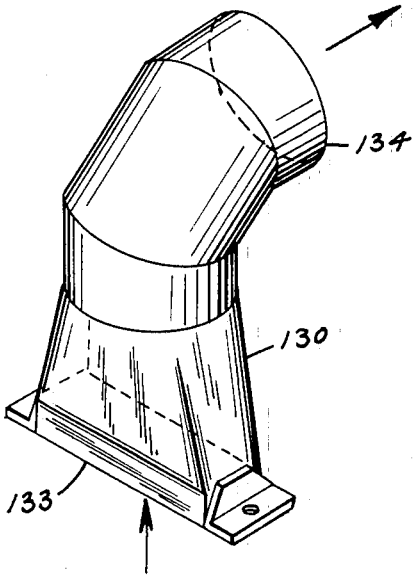

BOTTLE DECAPPER

BACKGROUND OF THE INVENTION

The field of this invention is bottle decapping devices for removing twist-type bottle caps from bottles.

Bottle filling operations sometimes require that caps be removed from bottles. For example, if the bottles are short-filled, that is, not filled full enough, the caps may have to be removed so more can be added or so that the bottles can be emptied, washed and refilled. For massive production volumes, the number of bottles requiring cap removal can result in an extremely tedious and time consuming manual task.

Machines to remove caps, and particularly twist-type caps, from bottles have been developed. Generally, they have involved relatively complicated apparatus. Another problem has been that the bottle caps, being metal and having corrugated or fluted sidewalls, are quite abrasive and therefore caused considerable wear in cap contacting parts of the decapping apparatus. The caps caused considerable wear because the cap contacting parts were made of a relatively soft material. The material was soft so that it would not ruin the finish of bottles from which the cap was removed while the bottle was still in contact with the decapping apparatus. Therefore, a need exists for a low-cost bottle decapper which reliably and automatically removes twist-type bottle caps, resists wear and preserves the finish of bottles during the decapping operation.

SUMMARY OF THE INVENTION

The invention provides a bottle decapper for removing twist-type bottle caps from bottles. A conveyor means moves the bottles relative to a frame while holding the bottles rotationally stationary relative to the frame. A cap engaging means positioned above the conveyor means and fixed to the frame includes a primary segment and a back-up segment. The primary segment has a hard file surface positioned in a plane to engage a side wall of a passing bottle cap in rolling contact to unscrew the bottle cap from the bottle. The back-up segment has a softer surface than the primary segment surface and is positioned downstream from the primary segment surface with the back-up surface in approximately the plane of the primary segment surface. The back-up segment surface therefore engages the sidewall of the cap of a passing bottle in rolling contact to finish unscrewing the cap from any bottle from which the caps were not completely unscrewed by the primary segment. In practically every case, the primary segment at least loosens the bottle caps from the bottles so that the back-up segment is not subjected to the wear associated with tightly screwed caps.

The primary segment is just long enough to loosen caps from practically every passing bottle. It is not excessively long to avoid removing the caps prematurely from the bottles and scraping the bottles on the primary segment. In the preferred form of the bottle decapper, to further ensure that the bottles do not scrape on the primary segment, a guide rail is provided to precisely guide the bottle caps into engagement with the primary segment. The guide rail is positioned between the primary and back-up segment surfaces and the conveyor means to contact the passing bottle in sliding contact. The guide rail is quite precisely adjustable, and since the distance between the edge of the bottle and the side wall of the bottle cap is fairly constant, the guide rail helps ensure that the bottles of any bottle caps which are completely unscrewed by the primary segment and are removed before the bottle reaches the end of the primary segment surface do not scrape on the primary segment surface to help preserve the finish of those bottles. Since the back-up segment surface is soft, it will not ruin the finish of bottles from which the caps have been completely unscrewed by the primary segment.

In another aspect of the invention, a second guide rail is transversely spaced from the plane of the segment surfaces above the conveyor means and below the bottle caps of passing bottles. The second guide rail engages in sliding contact the sides of the bottles opposite from the sides adjacent to the segment surfaces. The second guide rail helps guide the bottle caps into engagement with the segment surfaces and helps counteract forces which tend to urge the bottle caps away from the primary and back-up segments as the bottle caps are engaged in rolling contact thereby. In an especially preferred form, the guide rail is biased toward the plane of the segment surfaces.

It is therefore an object of the invention to provide a bottle decapper for reliably removing twist-type caps from bottles which is of a simple construction and is inexpensive to make.

It is another object of the invention to provide a bottle decapper which does not require frequent replacement of its cap engaging components.

It is another object of the invention to provide a bottle decapper which preserves the finish of decapped bottles.

These and other objects, advantages and aspects of the invention will become apparent from the following detailed description and from the drawings.

DESCRIPTION OF THE DRAWINGS

FIG. 1 is a schematic perspective view of a bottle decapper of the invention;

FIG. 2 is a top plan view of a conveyor means for the bottle decapper of FIG. 1;

FIG. 3 is a sectional view taken along the line 3—3 of FIG. 2 illustrating how a bottle is gripped by the conveyor means;

FIG. 4 is a top plan view of a cap engaging means for the bottle decapper of FIG. 1;

FIG. 5 is a fragmentary sectional view taken from the plane of the line 5—5 of FIG. 2 and showing the cap engaging means of FIG. 4 mounted to the conveyor means of FIG. 2;

FIG. 6 is an exploded perspective view of a portion of the cap engaging means of FIG. 4; and FIG. 7 is a perspective view of a vacuum hood for the cap engaging means of FIG. 4.

DESCRIPTION OF THE PREFERRED EMBODIMENT

FIG. 1 is a schematic view of a bottle decapper of the present invention. A conveyor means 8 for moving a bottle 10 relative to a frame 11 (FIG. 2) while holding the bottle 10 rotationally stationary relative to the frame 11 includes a pair of belts 12 and 13 which are driven in the same direction and at approximately the same speed. The bottle 10 is supported from beneath by a stationary wear strip 14. Approximately beneath a cap engaging means 15 are a pair of stationary dead plates 16 and 17 which rub on the outer sides of the belts 12 and 13, respectively. The dead plates 16 and 17 are spaced apart a distance such that the bottle is positively gripped by the belts 12 and 13 between the dead plates 16 and 17 to foreclose the possibility of the bottle 10 rotating for the length of the dead plates 16 and 17.

The cap engaging means 15 includes a primary segment 20 having a hard file surface 21 in a vertical plane. In practice, a section cut from a rasp file was found suitable. The file surface 21 is positioned to engage a sidewall 22 of a twist-type bottle cap 23 secured on the bottle 10 as the bottle is conveyed past the primary segment 20. The hard rough file surface 21 establishes rolling contact with the sidewall 22 and, since the bottle is held rotationally stationary, the cap 23 is rotated relative to the bottle 10 in the direction indicated. The direction of rotation is the direction required to unscrew the cap 23 from the bottle 10. Usually, the cap is unscrewed far enough by the time the bottle reaches the end of the primary segment 20 so that it can be lifted off the bottle 10 by a suitable vacuum system (not shown in FIG. 1) after the cap 23 clears the primary segment 20. In practically every case, the primary segment 20 at least loosens the bottle cap 23 so that it is not tightly twisted onto the bottle 10.

To complete the decapping process on those bottles for which the bottle caps were not completely unscrewed by the primary segment 20, a back-up segment 26 is provided down-stream from the primary segment 20. The back-up segment 26 provides a surface 27 which is softer than the surface 21 of the primary segment 20 and is in approximately the same vertical plane as the surface 21. In practice, the back-up segment 26 made from a section of soft belting or a rubber pad was found suitable. The frictional contact between the back-up segment 26 and the sidewall 22 of a loosened cap 23 is sufficient to rotate the cap relative to the bottle to finish unscrewing the cap from the bottle. For the bottles from which the caps are completely unscrewed by the primary segment 20 and removed by the vacuum system between the primary segment 20 and the back-up segment 26, the back-up segment, although it may contact glass surfaces of the bottle, does not ruin the finish of those surfaces because of its relative softness.

The surface 21 of the primary segment 20 is just long enough to loosen practically every cap 23 from the bottles 10. An excessive length of the surface 21 would result in the bottle caps being removed prematurely. In that event, a cap would be unscrewed before it reached the end of the surface 21. If it was unscrewed too far before the end of the surface 21, the cap could roll away from being between the bottle 10 and the surface 21 and roll off of the bottle. The glass surfaces of the bottle could possibly then scrape along the surface 21, thereby ruining the finish on the bottle. This would render the bottles unsuitable for refilling, resulting in waste of the bottles. On the other hand, the primary segment 20 could not be eliminated completely and replaced by extending the back-up segment 26. The back-up segment, being soft, would wear rapidly by contacting tightly secured bottle caps 23 resulting in excessive maintenance to replace the back-up segment 26.

FIGS. 2 and 3 show in more detail the conveyor means 8 for moving and holding the bottles 10 rotationally stationary past the cap engaging means 15. Referring particularly to FIG. 2, a conveyor 28 feeds bottles to the inlet of the belts 12 and 13. The path of each belt 12 and 13 is defined by pulleys 31, 32 and 33, by rollers 35, and by the dead plates 16 and 17.

Referring also to FIG. 3, each roller 35 is rotatably mounted between a pair of channel irons 38. The channel irons 38 are welded or otherwise securely attached to a connecting plate 39 of a mounting block 40. The mounting block 40 on the left side as viewed in FIG. 3 is bolted to a right-hand threaded nut 42 and the mounting block 40 on the right side as viewed in FIG. 3 is bolted to a left hand threaded nut 43. A lead screw 45 which is right hand threaded adjacent to the nut 42 and left-hand threaded adjacent to the nut 43 extends through the nuts 42 and 43 and is rotatable by a crank 47 (FIG. 2) to adjust the distance between the belts 12 and 13. A similar lead screw 47 with a similar arrangement of nuts 42 and 43 and mounting blocks 40 is provided downstream from the lead screw 45. Each connecting plate 39 spans the two mounting blocks 40 on each side of the conveyor and the lead screw 47 is connected to the lead screw 45 by a chain and sprocket drive 50 so that it also is rotatable by the crank 47. The lead screws 45 and 47 are mounted to the conveyor belt frame by suitable bearings 52.

As the spacing between the belts 12 and 13 is adjusted by rotating the crank 47, the tension of the belt must also be adjusted. For this purpose, each pulley 32 is adjustable by means of a lever 54 which is pivotable about a shaft 55. A pair of nuts on a stud 56 can be adjusted to pivot the lever arm 54 about the shaft 55 and adjust the tension of the belts 12 and 13.

FIGS. 4 and 5 show detailed views of the preferred form of cap engaging means 15. The cap engaging means 15 is mounted over the conveyor means 8 approximately at the location of the dead plates 16 and 17. Four threaded studs 59 (FIGS. 2, 4 and 5) are bolted to and extend up from the frame 11 to mount the cap engaging means 15. The studs 59 extend through the end plate 61 and nuts 63 are provided beneath the end plates 61 with nuts 64 provided above the end plates 61. The nuts 63 and 64 can be adjusted to adjust the vertical height of the cap engaging means 15 relative to the conveyor. This is important to vertically align the sidewall 22 of the cap 23 with the primary segment 20 and the back-up segment 26. Also, on the lower side as viewed in FIG. 4, holes 62 in the end plates 61 are obround and circular holes are provided in positioning plates 65. Each positioning plate 65 is made by welding a plate **65*a* to a plate 65*b* to form an elbow. Each positioning plate 65 is adjustable to be aligned with its corresponding stud 59 by a locking stud 66 which is threaded into the adjacent end plate 61. The positioning plates 65 are fixed by appropriate lock nuts on the locking stud 66 to ensure that the end plates 61, and therefore the respective primary and back-up segments 20 and 26, remain in their positions relative to the conveyor means 8**.

An adjusting plate 67 is bolted by three cap screws 68 to each end plate 61. A pair of spaced mounting plates 70 and 71 are welded or otherwise securely attached to and between the adjusting plates 67. The cap screws 68 extend through obround holes 72 in the adjusting plates 67 and are threaded into the end plates 61. Clamping plates 73 are bolted or otherwise securely attached to the sides of the end plates 61 adjacent to the ends of the adjusting plates 67. The clamping plates 73 extend above the end plates 61 and are each threaded to receive a bolt 75. The bolts 75 bear against the ends of the adjusting plates 67 to adjust the transverse location of the adjusting plates 67 relative to the end plates 61 and therefore relative to the conveyor means 8. This allows adjustment of the primary segment 20 and back-up segment 26 in the transverse direction to align them with the sidewall 22 of the bottle cap 23.

A mounting beam 80 is bolted to the mounting plate 70 by three cap screws 81. FIG. 6 best shows how various components are attached to the mounting beam 80. The primary segment 20 is received within a recess 83 and is secured therein by a clamping arm 85. The clamping arm 85 is threaded to be secured to the mounting beam 80 by a cap screw 86. The back-up segment 26 is received within a recess 87 and is secured therein by a retainer 89 which is secured to the mounting beam by two screws 91 and nuts 92 (FIG. 5). The recesses 83 and 87 are of a depth such that the respective surfaces 21 and 27 of the primary segment 20 and back-up segment 26 are in approximately the same plane to engage the sidewalls 22 of passing bottle caps 23 in rolling contact.

An adjustable guide rail 93 is secured to the bottom of the mounting beam 80 so that it is positioned between the primary and back-up segments 20 and 26 and the conveyor means 8. The guide rail 93 is made of an ultra high molecular weight plastic to provide a hard and lubricious surface for which the bottle 10 to bear against in sliding contact. The guide rail 93 is secured to the mounting beam 80 by a stud 95 which extends through the mounting plate 70, the mounting beam 80, the guide rail 93, and a guide retainer 96. The stud 95 is threaded into the guide retainer 96 and tightened by nuts 98 above the mounting plate 70 (FIG. 4). The stud 95 extends through an obround hole 99 in a diagonal slot 100 of the guide rail 93 and has a rib 101 which fits into the diagonal slot 100. The diagonal slot 100 is parallel to a ramp surface (shown in hidden lines) on the guide rail 93 which mates in sliding contact with a ramp surface 103 on the mounting beam 80.

The mounting arrangement of the guide rail 93 to the mounting beam 80 permits the guide rail 93 to be precisely adjusted in the transverse direction relative to the plane of the surfaces 21 and 27 by being slid longitudinally along the surface 103 of the mounting beam 80. Since the distance between the side of the bottle 10 which slides along the guide rail 93 and the sidewall 22 of the bottle cap 23 is fairly constant, the precise adjustment of the guide rail 93 allows accurate alignment of the sidewall 22 with the surfaces 21 and 27. Particularly with respect to the primary segment surface 21, this accurate alignment further ensures that the bottles of any bottle caps that are completely unscrewed by the primary segment and which roll away from being between the bottles and the primary segment surface are not scraped by the primary segment surface.

Transversely spaced from the guide rail 93 on the other side of the bottle 10 is another guide rail 110 (FIGS. 1, 4 and 5). The guide rail 110 is also made of an ultra high molecular weight plastic to provide a hard and lubricious surface in sliding contact with the bottle 10 below the bottle cap 23 and above the conveyor means 8. Both guide rails 93 and 110 have contoured surfaces in contact with the bottle 110 and taper at their inlet ends to better receive incoming bottles. The guide rail 110 is bolted to a biasing plate 112 by cap screws 113. The biasing plate 112 is hinged to the mounting plate 71 by a pair of straps 115. The straps 115 are bolted to the mounting plate 71 by cap screws 116 and the biasing plate 112 extends up between the straps 115. A pin 117 on each side of the biasing plate 112 pivotally connects each strap 115 to the biasing plate 112.

The guide rail 110 is biased against the neck of the bottle 10. This is accomplished by welding an extension 118 to the top portion of the biasing plate 112. A pair of studs 119 extend with suitable clearance through the extension plate 118, are threaded into the mounting plate 71, and are locked thereto by lock-nuts 120. A compression spring 122 is biased between the extension plate 118 and a nut 123 threaded onto each stud 119 to bias the extension plate 118 against the mounting plate 71. This biases the guide 110 toward the guide 93. An adjustment screw 125 is threaded through the extension plate 118 outward from the studs 119 and bears against the mounting plate 71. The adjustment screw 125 allows the spacing between the guide 110 and the surfaces 21 and 27 to be adjusted. The adjustment screw 125 is locked in place by a lock-nut 126.

It should be noted that the assembly including the guide rail 110 may not be required in all applications. As the sidewall 22 of the bottle cap 23 contacts the surface 21, a force is developed which tends to urge the bottle cap 23, and therefore the bottle 10, away from the surface 21. The guide rail 110 is provided mainly to counteract this force. The force is proportional to how tightly the bottle cap is screwed onto the bottle 10. If the bottle cap 23 is not very tightly screwed onto the bottle 10, then the forces imparted on the bottle by the belts 12 and 13 may be sufficient to hold the bottle cap 23 against the primary segment 20. By the same token, if the bottles are very strong bottles, then the belts 12 and 13 could be adjusted to exert relatively large forces on the bottle 10 to hold the bottle cap 23 against the surface 21. Although the guide rail 110, like the guide rail 93, preferably extends for the lengths of both the surfaces 21 and 27, the function it serves for the surface 27 is diminished since the cap 23 has already been loosened by the surface 21 thereby reducing the forces which tend to urge the bottle cap 23 away from the surface 27.

As mentioned above, a suitable vacuum system can be provided to clear unscrewed bottle caps away from the area of the cap engaging means 15 and conveyor means 8. For this purpose, a vacuum hood 130 shown in FIG. 7 can be bolted to the adjusting plates 67 using holes 132 provided in the adjusting plates 67. The inlet end 133 of the hood 130 substantially covers the open space defined by the adjusting plates 67 and the mounting plates 70 and 71. The exhaust end 134 is connected to a blower (not shown) to draw a vacuum through the hood 130 to suck unscrewed caps up through the hood 130 for disposal.

The back-up segment 26 is spaced a distance downstream from the primary segment 20. This is because even if the primary segment 20 completely unscrews a bottle cap 23 from a bottle 10, the bottle cap may roll along the surface 21 being pinched between the bottle 10 and the surface 21 and therefore remain on the bottle. Since there is a space between the primary and back-up segments 20 and 26, once a completely unscrewed cap reaches the end of the surface 21, it can be lifted off the bottle by the vacuum system.

Many modifications and variations of the preferred embodiment will be apparent to those skilled in the art which will still embody the invention. Therefore, the invention is not intended to be limited by the scope of the detailed description or of the drawings, but by the claims which follow.

We claim:

1. A bottle decapper for removing twist-type bottle caps from bottles, comprising:

a frame;

a conveyor means for moving the bottles relative to the frame while holding the bottles rotationally stationary relative to the frame;

a cap engaging means positioned above the conveyor means and fixed to the frame, said cap engaging means including:

a primary segment having a hard file surface positioned in a plane to engage a side wall of a passing bottle cap in rolling contact to unscrew the bottle cap from the bottle; and a back-up segment having a softer surface than said primary segment surface, said back-up segment being positioned downstream from the primary segment surface with said back-up segment surface in approximately the plane of the primary segment surface to engage the sidewall of the cap of a passing bottle in rolling contact; and wherein the primary segment loosens the bottle caps from the passing bottles and the back-up segment completes unscrewing the bottle caps from the bottles for any bottles from which the caps were not completely unscrewed by the primary segment.

2. A bottle decapper as in claim 1, wherein the cap engaging means further includes a guide rail positioned between the primary and back-up segment surfaces and the conveyor means, said guide rail contacting the passing bottle in sliding contact to guide the bottle cap into engagement with the primary and back-up segment surfaces.

3. A bottle decapper as in claim 1, further comprising a guide rail transversely spaced from the plane of the segment surfaces above the conveyor means and below the bottle cap of a passing bottle to engage in sliding contact the side of the bottle opposite from the side adjacent to the segment surfaces to help counteract forces which tend to urge the bottle cap away from the segment surfaces as the bottle cap is engaged thereby.

4. A bottle decapper as in claim 3, wherein the guide rail is biased toward the plane of the segment surfaces.

5. A bottle decapper as in claim 1, further comprising vacuum means to clear unscrewed bottle caps away from the area of the cap engaging means and the conveyor means.

6. A bottle decapper as in claim 5, wherein the back-up segment is spaced a distance downstream from the primary segment to provide an open space between the primary and back-up segments where a completely unscrewed bottle cap can clear the primary segment to be lifted off the bottle by the vacuum means.

* * * * *